United States Patent [19]

Olsen

[11] 4,215,858

[45] Aug. 5, 1980

[54] GAME APPARATUS

[76] Inventor: Eric H. Olsen, 709 W. Auburn Ct., Mequon, Wis. 53092

[21] Appl. No.: 899,306

[22] Filed: Apr. 24, 1978

[51] Int. Cl.[2] ..... A63F 9/00

[52] U.S. Cl. ..... 273/1 R

[58] Field of Search ..... 273/1 R, 1 E, 1 M, 157 R, 273/276; 46/24

[56] References Cited

U.S. PATENT DOCUMENTS

| | | | |
|---|---|---|---|
| 254,430 | 2/1882 | Crandall | 273/1 R |
| 2,188,043 | 1/1940 | Harrison | 273/157 R X |
| 3,649,018 | 3/1972 | Beam | 46/24 X |
| 3,706,456 | 12/1972 | Sesti et al. | 273/276 |
| 3,712,616 | 1/1973 | Goldfarb et al. | 273/1 R |
| 3,788,641 | 1/1974 | Lemelson | 273/1 M |
| 3,994,492 | 11/1976 | Breslow | 273/1 R |

*Primary Examiner*—Paul E. Shapiro

*Attorney, Agent, or Firm*—Michael, Best & Friedrich

[57] ABSTRACT

A game apparatus including a plurality of playing blocks arranged in a stacked layered pyramid arrangement and including a bottom layer and an intermediate layer, the intermediate layer supported by the bottom layer and positioned centrally thereon, each of the blocks of the intermediated layer supported by a plurality of blocks of the bottom layer, and the arrangement of the blocks being such as to allow removal of some but not all of the blocks of the intermediate and bottom layers without causing collapse of other blocks. The blocks each have planar faces and each include a recess, and a thin member is positioned in each recess and the thin member generally bisects the recess. The game apparatus also includes a rod having a hook formed in one end, the hook receivable in the recess and engageable with the thin member for removing selected blocks from the pyramid formation.

6 Claims, 5 Drawing Figures

GAME APPARATUS

BACKGROUND OF THE INVENTION

The present invention relates to games and more particularly to game apparatus including a plurality of blocks which can be stacked in layered relation to form a pyramid structure and including means for engaging respective blocks to permit the blocks to be individually removed from the pyramid structure.

Attention is directed to the following U.S. Pat. Nos. each related to game apparatus:

3,168,311 Sinden Feb. 2, 1965, 2,752,158 Brunot, et al June 26, 1956, 3,166,325 First Jan. 19, 1965, 3,356,369 Stubbmann Dec. 5, 1967.

SUMMARY OF THE INVENTION

The invention provides a game apparatus including a plurality of playing blocks arranged in a stacked layered pyramid arrangement and including a bottom layer and an intermediate layer, the intermediate layer supported by the bottom layer and positioned centrally thereon. Each of the blocks of the intermediate layer are supported by a plurality of blocks of the bottom layer, and the arrangement of the blocks is such as to allow removal of some but not all of the blocks of the intermediate and bottom layers without causing collapse of other blocks.

In accordance with one embodiment of the invention the blocks each have planar faces and each of the planar faces includes a recess. A thin member is positioned in each recess, bisecting the recess.

The game apparatus also includes means for removing selected blocks from the pyramid formation including a rod having a hook formed in one end, the hook receivable in the recess and engageable with the thin member.

The invention also provides a playing board having a flat playing surface, the playing surface divided into a plurality of delineated small areas for occupancy by playing blocks.

The invention further provides a pair of dice, one of the dice having an unnumbered surface, and the other of the dice having a pair of unnumbered surfaces.

One of the principal features of the invention is the provision of the blocks being cubical and including numbered indicia on at least one of their faces and the blocks forming at least four layers including a bottom layer, at least a pair of intermediate layers including an upper intermediate layer and a lower intermediate layer, the upper intermediate layer including four blocks, and a top block supported by the four blocks of the upper intermediate layer.

Other features and advantages of the invention will become known by reference to the following description and drawings.

Figure 1:
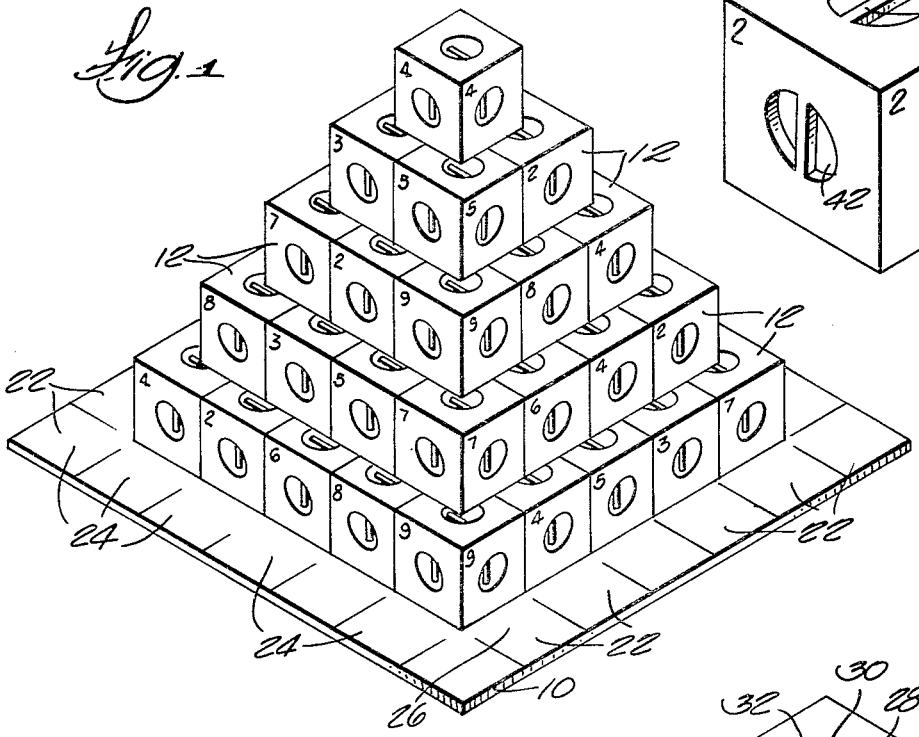
FIG. 1 is a perspective view of a pyramid formation of blocks supported on a game board in accordance with the present invention.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Figure 2:
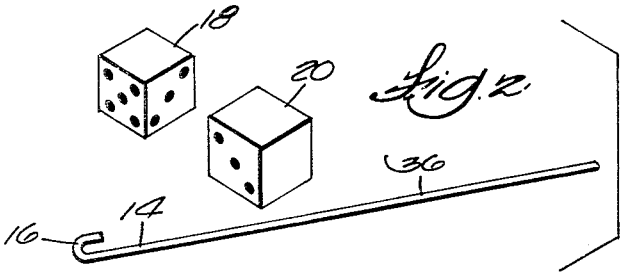
FIG. 2 is a perspective view of a hook and a pair of dice in accordance with the invention, and showing one die with one face unnumbered and the second die with two faces unnumbered.

Game apparatus of the invention is shown in FIG. 1 and generally includes a game board 10 supporting a plurality of cubical blocks 12 arranged in a stacked, layered pyramid formation. Referring to FIG. 2, the embodiment of the game apparatus shown therein also generally includes one or more block extraction tools 14 having a hook 16 at one end and also a pair of dice 18 and 20. The game board 10 is divided into a grid or network of narrow strips 22 and perpendicular narrow strips 24 which divide the board 10 into a multiplicity of square areas 26 upon which the blocks 12 are adapted to be placed.

Figure 3:
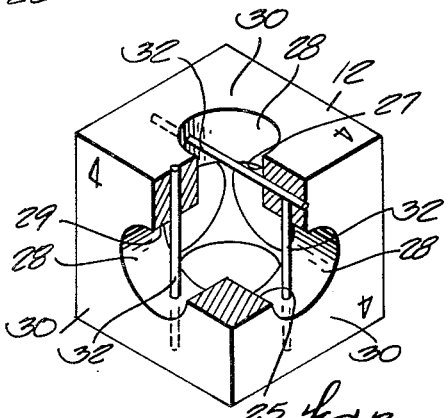
FIG. 3 is an enlarged perspective view of one of the blocks shown in FIG. 1 and with portions broken away in the interest of clarity.

The blocks 12 are cubical and may be comprised of wood, metal or plastics. One preferred embodiment of the blocks 12 is shown in FIG. 3 wherein blocks 12 are shown as each including a recess 28 in each of their planar faces 30, the recesses 28 respectively centrally positioned relative to the edges of the planar faces 30. The recesses 28 are formed by three mutually perpendicular cylindrical bores 25, 27 and 29 extending through the block and intersecting at the center of the block. A thin member or pin 32 is positioned in each of the respective recesses 28 and has its opposite ends imbedded in the block 12 whereby the pin 32 is rigidly supported. The pin 32 has a longitudinal axis generally parallel to the plane of the adjacent face 30 of the block and is recessed from the face 30 of the block and generally bisects the recess 28. The blocks 12 are intended to have identifying numbers printed on each of their faces. In one preferred form of the invention, for purposes of example, the blocks are numbered "1" through "9" and there are a plurality of blocks bearing each number. An additional block bears the number "10" and has a color different from that of the other blocks.

Figure 4:
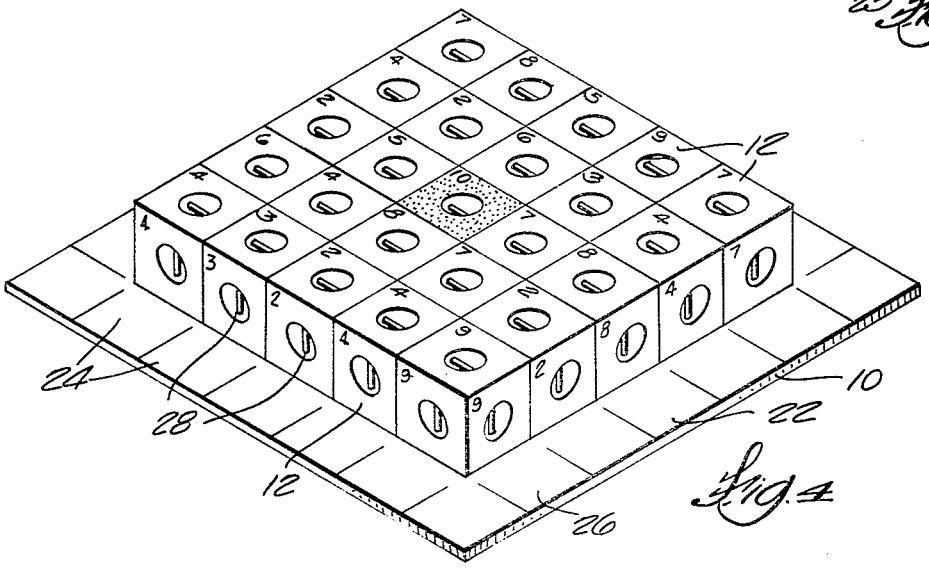
FIG. 4 is a perspective view of the bottom layer of blocks shown in FIG. 1 supported on the playing board.

The blocks 12 are positioned on the playing board 10 in layered stacked arrangement, and as shown in FIG. 4 the first layer of blocks is comprised of a square arrangement of twenty-five blocks five blocks square in mutually contiguous relationship. The blocks of the bottom layer are arranged in five rows of five blocks, the blocks 12 of each row being linearly aligned and contiguous and the rows being mutually contiguous. Each of the blocks 12 is positioned on one of the squares 26 on the playing board 10. The block bearing the number "10" is placed in the center of the bottom layer. The second square layer of blocks 12 is placed on the bottom layer. The second layer is intended to have four blocks on a side rather than five blocks on a side as in the bottom layer, and the second layer is positioned centrally on the bottom layer such that each block of the second layer is supported by four blocks of the bottom layer. More specifically, the second layer is formed by four rows of four blocks, each of the rows of the second layer supported on and between two adjacent rows of the bottom layer and equidistant the opposite ends of those two rows of the bottom layer. The third square layer includes three blocks on a side and is positioned centrally on the second layer, the third layer including three contiguous rows of three blocks, each of those rows positioned on two rows of the second layer and equidistant the opposite ends of those two rows. The fourthlayer is comprised of a square formed by four adjacent blocks positioned centrally on the third layer. A single block 12 is supported by the fourth layer centrally thereof so that each of the four blocks of the fourth layer support a corner of the single block thereon.

The block extracting tool 14 may be constructed in one embodiment as shown in FIG. 2, wherein it is comprised of a thin metal elongated rod 36 and a curved end forming the hook 16. The hook 16 is smaller than the diameter of the recesses 28 and is intended to be received in the respective recesses 28 in the blocks 12 to engage the pin 32 held in that recess to facilitate removal of selected blocks 12 from the pyramid formation. Using the tool 14, the selected block 12 can be pulled horizontally outwardly away from the center of the pyramid formation. Other tools such as forceps could also be conveniently used as block extracting tools.

One of the dice 18 of the pair includes indicia indicating "1" through "5" on its faces. In the preferred embodiment, the sixth face of die 18 is unnumbered and colored to match the color of the single block bearing the number "10+. The other of the pair of dice 20 includes indicia indicating "1" through "4" on its faces. The remaining two faces are unnumbered and are colored to match the color of the block bearing the number "10" and placed in the center of the bottom layer.

During the playing of the game, the blocks 12 are stacked in pyramid formation on the playing board 10 in the manner described. The game can be played by two or more, and the first player rolls the pair of dice 18 and 20 and locates an accessible block 12 having a number matching the value of the pair of dice. The player then attempts to remove that block using the tool 14 and without causing blocks on a higher layer of the pyramid formation to fall. Since each of the blocks 12 of the upper layers is supported by four blocks, careful removal of one of the blocks of one of the lower layers is possible and will leave each of the blocks previously supported by that block still supported by three remaining blocks. In the preferred construction, the blocks 12 have a surface with a relatively low coefficient of friction such that the blocks can be easily removed from the pyramid formation without disturbing adjacent blocks. As play continues, another player then rolls the dice 18 and 20 and attempts to extract another block 12 from the pyramid formation. If a player is unable to remove a block having a number corresponding to the value of the dice without causing a higher block to fall, or if in attempting to remove a block, a higher block falls, the player forfeits his turn. Play end when the block positioned in the center of the bottom layer is removed. That block may be removed when a player rolls the dice and both dice display an unnumbered surface and if the block is accessible and can be removed without causing other blocks to fall. At the conclusion of the game, the player having blocks with the highest sum is the winner.

Figure 5:
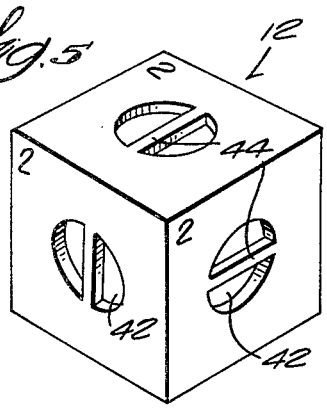
FIG. 5 is a perspective view similar to FIG. 3 but showing an alternative block.

An alternative embodiment of the blocks of the game apparatus of the invention is shown in FIG. 5. The blocks 12 shown therein are hollow and are comprised of molded plastic. The blocks 12 include a plurality of planar square walls 40 defining the planar faces 30. The square walls 40 each include a central aperture 42 therein bisected by an integral thin member 44 coplanar with the respective face 30. The member 44 performs the same function as pin 32 but is an integral molded part of the block 12.

I claim:

1. Game apparatus comprising:

a playing board having a flat playing surface, means on said board dividing said playing surface into a plurality of delineated small areas for occupancy by playing blocks, a plurality of cubical playing blocks arranged in a stacked layered pyramid arrangement on said playing board and including at least four layers of said blocks including a bottom layer, a pair of intermediate layers including an upper intermediate layer and a lower intermediate layer, said upper intermediate layer including four blocks, said lower intermediate layer supported by said bottom layer and positioned centrally thereon, each of said blocks of said lower intermediate layer supported by four blocks of said bottom layer, and a top block supported by each of said four blocks of the upper intermediate layer, and the arrangement of said blocks being such as to allow removal of some but not all of said blocks of said intermediate and bottom layers without causing collapse of other blocks, said blocks each having planar faces, each of said planar faces having a recess and a thin member positioned in each recess and having a longitudinal axis generally parallel to the plane of the adjacent face, and said thin member generally bisecting said recess, and indicia on at least one face of said blocks, and means for removing selected blocks from said pyramid formation, said removing means including a rod having a hook formed in one end, said hook receivable in said recess and engageable with said thin member.

2. The game apparatus set forth in claim 1 wherein said bottom layer includes a center block having distinctive coloring.

3. The game apparatus set forth in claim 2 and further including a pair of dice, one of said dice having an unnumbered surface, and the other of said dice having a pair of unnumbered surfaces.

4. Game apparatus comprising:

a playing board having a flat playing surface, means on said board dividing said playing surface into a plurality of delineated small areas for occupancy by playing blocks, a plurality of cubical playing blocks arranged in a stacked layered pyramid arrangement on said playing board and including at least four layers of said blocks including a bottom layer, a pair of intermediate layers including an upper intermediate layer and a lower intermediate layer, said upper intermediate layer including four blocks, said lower intermediate layer supported by said bottom layer and positioned centrally thereon, each of said blocks of said lower intermediate layer supported by four blocks of said bottom layer, and a top block supported by each of said four blocks of the upper intermediate layer, and the arrangement of said blocks being such as to allow removal of some but not all of said blocks of said intermediate and bottom layers without causing collapse of other blocks, said blocks each having planar faces, each of said planar faces having a recess, and a thin member positioned in each recess and having a longitudinal axis generally parallel to the plane of an adjacent face, and said thin member generally bisecting said recess, and indicia on said blocks, means for removing selected blocks from said pyramid formation, said removing means including a rod having a hook formed in one end, said hook receivable in said recess and engageable with said thin member, and a pair of dice, one of said dice having an unnumbered surface, and the other of said dice having a pair of unnumbered surfaces.

5. Game apparatus comprising a plurality of playing blocks adapted to be arranged in a stacked layered pyramid arrangement and including at least a bottom layer and an intermediate layer, said intermediate layer being supported by said bottom layer and positioned centrally thereon, each of said blocks of said intermediate layer being supported by a plurality of blocks of said bottom layer, and the arrangement of said blocks being such as to allow removal of some but not all of said blocks of said intermediate and bottom layers without causing collapse of other blocks, said blocks each having planar faces, at least one of said planar faces having a recess, and a thin member positioned in said recess, and means for removing selected blocks from said pyramid formation, said means for removing selected blocks from said pyramid formation including a rod having a hook formed in one end, said hook receivable in said recess of a selected one of said blocks and engageable with said thin member.

6. Game apparatus comprising a plurality of playing blocks adapted to be arranged in a stacked layered pyramid arrangement and including at least a bottom layer and an intermediate layer, said intermediate layer being supported by said bottom layer and positioned centrally thereon, each of said blocks of said intermediate layer being supported by a plurality of blocks of said bottom layer, the arrangement of said blocks being such as to allow removal of some but not all of said blocks of said intermediate and bottom layers without causing collapse of other blocks, and said bottom layer including a center block having distinctive coloring, and means for removing selected blocks from said pyramid formation.

* * * * *